US006817447B1

(12) United States Patent
Pedersen

(10) Patent No.: US 6,817,447 B1
(45) Date of Patent: Nov. 16, 2004

(54) STAIR OR LADDER STEPS OF THE PLATE-SHAPED STEP TYPE

(75) Inventor: Peder Fahrsen Pedersen, Vildbjerg (DK)

(73) Assignee: PF Management ApS (DK)

( * ) Notice: Subject to any disclaimer, the term of this patent is extended or adjusted under 35 U.S.C. 154(b) by 586 days.

(21) Appl. No.: 08/849,336

(22) PCT Filed: Dec. 7, 1995

(86) PCT No.: PCT/DK95/00491

§ 371 (c)(1),
(2), (4) Date: Jun. 6, 1997

(87) PCT Pub. No.: WO96/18008

PCT Pub. Date: Jun. 13, 1996

(30) Foreign Application Priority Data

Dec. 7, 1994 (DK) ..... 1391/94

(51) Int. Cl.[7] ..... E06C 7/00
(52) U.S. Cl. ..... 182/228.1
(58) Field of Search ..... 187/228.1, 228.2, 187/228.4, 228.6, 119, 222

(56) References Cited

U.S. PATENT DOCUMENTS

| | | | | | |
|---|---|---|---|---|---|
| 1,340,243 A | * | 5/1920 | Oliver | ..... | 182/228.2 |
| 3,016,976 A | * | 1/1962 | Munson | ..... | 182/228.1 |
| 3,593,821 A | * | 7/1971 | Lisler | ..... | 182/156 |
| 4,331,218 A | * | 5/1982 | Layher | ..... | 182/222 |
| 4,723,631 A | * | 2/1988 | Tremblay | ..... | 182/228.1 |
| 5,355,974 A | * | 10/1994 | Miller | ..... | 182/187 |

FOREIGN PATENT DOCUMENTS

| | | | | |
|---|---|---|---|---|
| DE | 1921516 | * 11/1970 | ..... | 182/222 |
| EP | A-2 316 409 | 7/1975 | ..... | E04F/11/02 |
| EP | 33475 | * 8/1981 | ..... | 182/1 |
| EP | A-0 516 999 | 5/1992 | ..... | E04F/11/02 |
| FR | A-2 218 455 | 2/1974 | ..... | E04F/11/08 |
| GB | 1352069 | * 5/1974 | ..... | 182/228.2 |
| GB | 1590522 | * 6/1981 | ..... | 182/222 |
| IT | 570931 | * 12/1957 | ..... | 182/228.2 |

* cited by examiner

*Primary Examiner*—Alvin Chin-Shue
(74) *Attorney, Agent, or Firm*—Connolly Bove Lodge & Hutz LLP

(57) ABSTRACT

A stair step of the plate-shaped step type comprises plate members bent downwards from the stepping surface at all four rims. The plate members are welded together at the corners where they abut one another. The plate members at the front and rear rims are rolled over to form cylindrical pipes, such that the plate member at the front rim is rounded at the bottom, thereby preventing jamming of the foot between the steps. The cylindrical pipes are filled with a foamed insulating material, such as polyurethane foam.

3 Claims, 1 Drawing Sheet

STAIR OR LADDER STEPS OF THE PLATE-SHAPED STEP TYPE

FIELD OF THE INVENTION

The invention relates to stair or ladder steps of the plate-shaped step type, where plate members bent downwards are provided at all four rims of the stepping surface, i.e., at the front rim, the rear rim, and the two side rims. The downwardly bent rims are welded together at the corners where said plate members abut one another due to the bending.

BACKGROUND OF THE INVENTION

Stair or ladder steps of the above shape are known, for instance from the products previously sold by the Applicant, as illustrated in sales brochures.

Such stair or ladder steps are usually secured between the stringers by bolts extending through openings in each of the two plate members bent downwards at the side rims, and then further extending through openings in the respective adjacent stringers. Obviously, the ladder steps can, also be secured to the stringers in other ways, such as by welding.

Such a stair necessitates a predetermined height of the individual steps, this height corresponding to the width of the plate members bent downwards, in order to ensure that the steps can stand the required loads. Thus an opening is provided between the stepping surface of a step and the lower rim of the front rim bent downwards of the step just thereabove. This opening presents an undesired "foot trap" because a foot can get jammed in this opening or be injured by the rather sharp plate rim.

When the width of the front rim is low in such a manner that the step is of a low height and the above opening is therefore sufficiently large for avoiding the foot trap, the resulting step does not have a sufficient strength. On the other hand, when the front rim extends to the stepping surface of the step therebelow, the consumption of material is relatively extensive and the stepping surface is not particularly wide, although the foot trap has indeed thereby been avoided.

SUMMARY OF THE INVENTION

The object of the invention is to provide stair or ladder steps of the above type, with improved utilization of the materials compared to previously known steps of the plate-shaped step type, this utilization of the materials being expressed by the relationship of the strength and weight of a step, and in which the "foot trap" involved when the step forms part of a stair structure is avoided.

In stair or ladder step according to the invention, the plate member bent downwards at the front rim is rolled over to form a cylindrical pipe.

In this manner, the sharp plate rim is avoided at the front rim bent downwards, and furthermore the foot trap is avoided because plenty of room is provided for a foot. In addition, the step is provided with a rather high strength.

The plate member bent downwards at the rear rim is also rolled over to form a cylindrical pipe, thereby providing further reinforcement of the step. In addition, the front rim and the rear rim can be identical, with the result that the stair or ladder step can be turned 180° about a vertical axis of symmetry in connection with the mounting procedure.

Further reinforcement of the step may be obtained by also welding the locations where the ends of the cylindrical pipes abut the plate members bent downwards at the side rims.

It is, of course, possible to use several types of soundproofing materials, but polyurethane foam turned out to be extremely advantageous for the purpose.

BRIEF DESCRIPTION OF THE DRAWINGS

The invention is explained in greater detail below with reference to the accompanying drawings, in which.

DESCRIPTION OF PREFERRED EMBODIMENT

Figure 2:
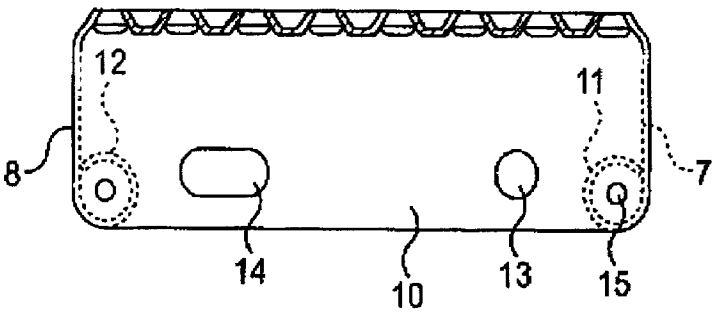
FIG. 2 illustrates the stair or ladder step of FIG. 1, seen from one side rim.
Figure 3:
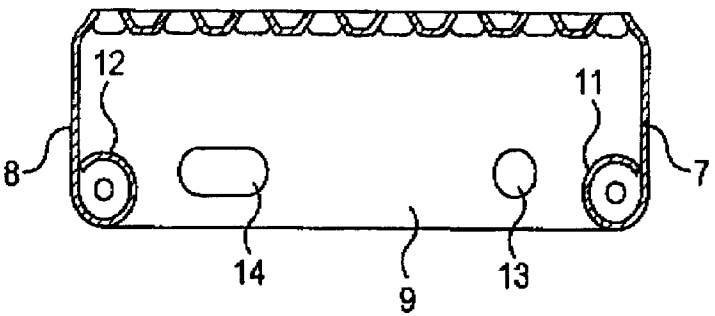
FIG. 3 is a cross-sectional view taken along the line A—A of FIG. 1.
Figure 1:
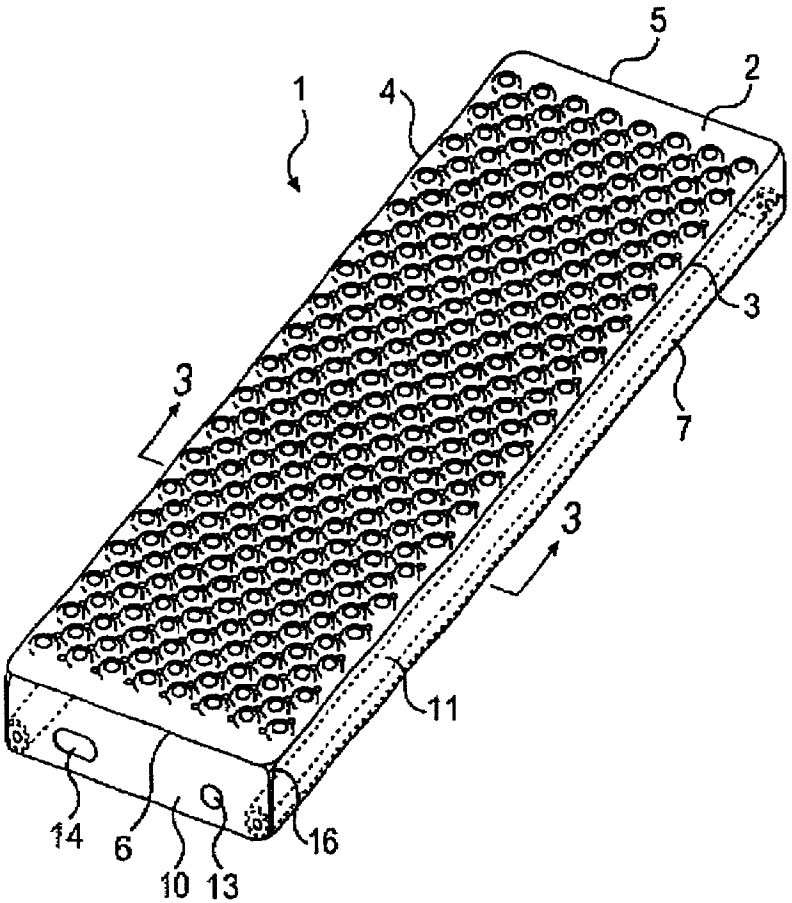
FIG. 1 is a perspective view of a stair or ladder step according to the invention.

The stair or ladder step 1 shown in FIG. 1 comprises a stepping surface 2 with a front rim 3, a rear rim 4, and two side rims 5 and 6, respectively.

At the above rims 3, 4, 5, and 6 the step 1 comprises plate members 7, 8, 9, and 10, respectively, bent downwards from the stepping surface 2. The plate members 7 and 8, respectively, bent downwards at the front and rear rims 3 and 4, respectively, are rolled over to form respective cylindrical pipes 11 and 12. The plate members 7, 8, 9, and 10 are thus preferably perpendicular to the stepping surface 2.

The plate members 7, 8, 9, and 10 bent downwards are welded together at the corners, where the plate members abut one another due to the bending. The welds also include the locations where the ends of the cylindrical pipes 11 and 12 abut the plate members 9 and 10 bent downwards at the side rims 5, 6. The welds are preferably provided in the form of seams, but they may also be spot welds.

The plate members 9 and 10 bent downwards comprise holes or openings 13, 14 for mounting bolts (not shown), these openings allowing the step to be secured to stringers (not shown) in a manner known per se.

The plate members further comprise openings 15 communicating with the interior of the cylindrical pipes 11, 12. Through these openings 15 the cylindrical pipes 11, 12 are filled with a foamed soundproofing material, preferably polyurethane foam. Rubber-like soundproofing materials can also be used.

The stepping surface 2 may be planar and optionally coated with an anti-skid layer, but it is preferably shaped, in a manner known per se, with an aperture pattern where the rims of the apertures project beyond the plane of the stepping surface 2. The rims about the apertures provide resistance against skidding of the shoe sole of a person. Furthermore, this shaping of the stepping surface by way of cold deformation provides a reinforcement for the step.

The stair or ladder step can be made of stainless steel or aluminum; but often it is preferred to manufacture the step from steel electroplated after manufacture. Small apertures 16 are formed at the four corners for the electroplating process, the stepping surface 2 abutting two abutting plate members bent downwards at the four corners.

Within the scope of the invention, only the plate member bent downwards at the front rim of the stepping surface is rolled over to form a cylindrical pipe, although all advantages are not obtained by such a structure 8 i.e., while the foot trap is avoided, the total reinforcement and soundproofing effect are not obtained. Furthermore, it is of importance how the stair or ladder step is turned at the mounting of the staircase.

What is claimed is:

1. A plate-shaped stair step having a stepping surface with a front rim, a rear rim and two side rims, each of said rims being provided with plate members having downwardly bent portions welded together at corners where said plate members abut one another due to the bending, wherein the plate members bent downwards at said front and rear rims are rolled over to form a cylindrical pipe, and including welds at locations where ends of said cylindrical pipes abut the plate members bent downward at said side rims.

2. A stair step as claimed in claim 1, wherein said plate members bent downward at said side rims comprise through openings communicating with interiors of said cylindrical pipes, and said cylindrical pipes are filled with a foamed soundproofing material.

3. A stair step as claimed in claim 2, wherein said soundproofing material is polyurethane.

* * * * *